US009922607B2

(12) United States Patent
Song et al.

(10) Patent No.: US 9,922,607 B2
(45) Date of Patent: Mar. 20, 2018

(54) LIQUID CRYSTAL DISPLAY DEVICE AND DRIVING METHOD THEREOF

(75) Inventors: Hong Sung Song, Gumi-si (KR); Woong Ki Min, Daegu-si (KR); Su Hyuk Jang, Daegu-si (KR)

(73) Assignee: LG DISPLAY CO., LTD., Seoul (KR)

( * ) Notice: Subject to any disclaimer, the term of this patent is extended or adjusted under 35 U.S.C. 154(b) by 772 days.

(21) Appl. No.: 12/153,708

(22) Filed: May 22, 2008

(65) Prior Publication Data

US 2008/0291189 A1 Nov. 27, 2008

(30) Foreign Application Priority Data

May 25, 2007 (KR) ..... P2007-0050829

(51) Int. Cl.

| | |
|---|---|
| ***G09G 5/00*** | (2006.01) |
| ***G09G 3/36*** | (2006.01) |
| *G09G 3/20* | (2006.01) |

(52) U.S. Cl.

CPC ..... *G09G 3/3614* (2013.01); *G09G 3/2014* (2013.01); *G09G 3/3648* (2013.01); *G09G 3/3677* (2013.01); *G09G 2310/0224* (2013.01); *G09G 2310/0251* (2013.01); *G09G 2320/0204* (2013.01); *G09G 2320/0247* (2013.01); *G09G 2320/0257* (2013.01); *G09G 2320/0261* (2013.01)

(58) Field of Classification Search

CPC ..... G09G 3/3614
USPC ..... 345/89, 95, 96, 98, 209, 210; 349/36
See application file for complete search history.

(56) References Cited

U.S. PATENT DOCUMENTS

| | | | | |
|---|---|---|---|---|
| 2004/0032385 | A1* | 2/2004 | Park et al. | 345/95 |
| 2004/0104881 | A1* | 6/2004 | Furuya | 345/98 |
| 2005/0110737 | A1* | 5/2005 | Hosotani | 345/92 |
| 2005/0122295 | A1* | 6/2005 | Sawabe | 345/88 |
| 2005/0190118 | A1* | 9/2005 | Ryu et al. | 345/58 |
| 2008/0068404 | A1* | 3/2008 | Ishii | 345/690 |

FOREIGN PATENT DOCUMENTS

| | | | | |
|---|---|---|---|---|
| CN | 1619635 | | 5/2005 | |
| CN | 1661665 | | 8/2005 | |
| JP | 2004354602 | A * | 12/2004 | G09G 3/36 |
| KR | 10-2005-0054465 | A | 6/2005 | |

* cited by examiner

*Primary Examiner* — Bryan Earles
(74) *Attorney, Agent, or Firm* — Dentons US LLP

(57) ABSTRACT

A liquid crystal display (LCD) device includes a liquid crystal display panel having a matrix of liquid crystal cells defined by crossings of the data lines and the gate lines. The LCD device includes a data driving circuit for inverting a polarity of a data voltage in response to a polarity control signal, and supplying the polarity-inverted data voltage to an associated one of the data lines in response to a source output enable signal; a gate driving circuit for sequentially supplying a scan voltage to each of the gate lines in response to a gate output enable signal; and a controller for modulating the polarity control signal such that data voltages having the same polarity are respectively supplied to liquid crystal cells along one gate line in consecutive frame periods and generating the source output enable signal and the gate output enable signal.

3 Claims, 14 Drawing Sheets

FIG. 5

| Line \ Frame | Pre | 1 | 2 | 3 | 4 | 5 | 6 | 7 | 8 | 9 | 10 | ... | n−1 | n |
|---|---|---|---|---|---|---|---|---|---|---|---|---|---|---|
| Line #1 | + | + | − | + | − | + | − | + | − | + | − | ... | + | − |
| Line #2 | − | + | + | − | + | − | + | − | + | − | + | ... | − | + |
| Line #3 | + | − | + | + | − | + | − | + | − | + | − | ... | + | − |
| Line #4 | − | + | − | + | + | − | + | − | + | − | + | ... | − | + |
| Line #5 | + | − | + | − | + | + | − | + | − | + | − | ... | + | − |
| Line #6 | − | + | − | + | − | + | + | − | + | − | + | ... | − | + |
| Line #7 | + | − | + | − | + | − | + | + | − | + | − | ... | + | − |
| Line #8 | − | + | − | + | − | + | − | + | + | − | + | ... | − | + |
| Line #9 | + | − | + | − | + | − | + | − | + | + | − | ... | + | − |
| Line #10 | − | + | − | + | − | + | − | + | − | + | + | ... | − | + |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| Line #n | − | + | − | + | − | + | − | + | − | + | − | ... | + | + |

FIG. 7

| Frame | 1 | 2 | ... | n | n+1 | ... | 2n | 2n+1 | ... | 3n | 3n+1 |
|---|---|---|---|---|---|---|---|---|---|---|---|
| POL | + | + | ... | − | − | ... | + | + | ... | − | − |

LIQUID CRYSTAL DISPLAY DEVICE AND DRIVING METHOD THEREOF

This application claims the benefit of the Korean Patent Application No. 10-2007-0050829, filed on May 25, 2007 which is hereby incorporated by reference for all purposes as if fully set forth herein.

BACKGROUND OF THE INVENTION

Field of the Invention

The present invention relates to a liquid crystal display (LCD) device, and more particularly, to an LCD device and a driving method thereof.

Discussion of the Related Art

LCD devices display images by controlling the light transmittance of liquid crystal cells in accordance with a video signal. Referring to FIG. 1, an active matrix type LCD device is illustrated. In such an active matrix type LCD device, data voltages that are supplied to liquid crystal cells Clc, are switched by thin film transistors (TFTs) formed in respective liquid crystal cells Clc, for active control of data to achieve an enhancement in the display quality of a moving image. In FIG. 1, the reference character "Cost" designates a storage capacitor that maintains the data voltage charged in the associated liquid crystal cell Clc, the reference character "D1" designates a data line that is supplied with the data voltage, and the reference character "G1" designates a gate line that is supplied with a scan voltage.

An LCD display device having the above-described configuration may be driven in accordance with an inversion scheme, in which polarity inversion not only occurs between neighboring liquid crystal cells, but also occurs at intervals of one frame. The inversion driving scheme is employed to reduce DC offset components and to reduce degradation in liquid crystals. However, when any one of data voltages having opposite polarities is dominantly supplied for a prolonged period of time, image sticking may occur. Such image sticking is called "DC image sticking" because the image sticking occurs as each liquid crystal cell is repeatedly charged with voltages having the same polarity. An example of such a case is the case in which data voltages are supplied to the LCD device in accordance with an interlace scheme. In accordance with the interlace scheme, data voltages are supplied to liquid crystal cells on odd horizontal lines in odd frame periods, while being supplied to liquid crystal cells on even horizontal lines in even frame periods.

FIG. 2 is a waveform diagram depicting an example in which data voltages are supplied to each liquid crystal cell Clc in accordance with the interlace scheme. In this example, it is assumed that the liquid crystal cell Clc supplied with the data voltages depicted in FIG. 2 is one of the liquid crystal cells arranged on one odd horizontal line.

Referring to FIG. 2, a positive voltage is supplied to the liquid crystal cell Clc in odd frame periods, and a negative voltage is supplied to the liquid crystal cell Clc in even frame periods. Since a data voltage having a high positive polarity level is supplied to liquid crystal cells Clc arranged on odd horizontal lines, only in odd frame periods, in accordance with the interlace scheme, the positive data voltage becomes dominant during 4 frame periods, as compared to the negative voltage, as shown by the waveform in the box of FIG. 2. FIG. 3 is an image showing the experimental results of DC image sticking occurring due to interlace data. When an original image corresponding to the left image in FIG. 3 is supplied to an LCD panel for a certain period of time in accordance with the interlace scheme, the data voltage, which is varied in polarity at intervals of one frame, exhibits a considerable level difference between the odd frame and the even frame, as shown in FIG. 2. As a result, when a data voltage having an intermediate gray scale value, for example, a gray scale value of 127, is supplied to all liquid crystal cells Clc of the LCD panel, after the display of an original image such as the left image in FIG. 3, the pattern of the original image is dimly displayed, as shown by the right image in FIG. 3. That is, DC image sticking occurs.

Another example of DC image sticking occurs in a case in which an image is moved or scrolled at a certain speed. When an image is moved or scrolled at a certain speed, voltages of the same polarity may be repeatedly accumulated in each liquid crystal cell Clc in accordance with the correlation between the size of the scrolled figure and the scroll speed (moving speed). This example is illustrated in FIG. 4, which shows the experimental results of DC image sticking occurring when an oblique line pattern or a character pattern is moved at a certain speed.

The moving image display quality of the LCD device may be degraded not only due to DC image sticking, but also due to flicker, namely, a periodic brightness difference that the viewer can see with the naked eye. It is desirable to prevent the occurrence of DC image sticking and flicker to enhance the display quality of the LCD device.

SUMMARY OF THE INVENTION

Accordingly, the present invention is directed to a liquid crystal display device and a driving method thereof that substantially obviate one or more problems due to limitations and disadvantages of the related art.

An advantage of the present invention is to provide a liquid crystal display device and a driving method thereof, which are capable of preventing direct current (DC) image sticking, thereby achieving an enhancement in display quality.

Another advantage of the present invention is to provide a liquid crystal display device and a driving method thereof, which are capable of preventing flicker, thereby achieving an enhancement in display quality.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes: a liquid crystal display panel having a plurality of data lines that cross a plurality of gate lines to define a matrix of liquid crystal cells; a data driving circuit for inverting a polarity of data voltage in response to a polarity control signal, and supplying the polarity-inverted data voltage to an associated one of the data lines in response to a source output enable signal; a gate driving circuit for sequentially supplying a scan voltage to each of the gate lines in response to a gate output enable signal; and a controller for modulating the polarity control signal such that the polarity of the data voltages respectively supplied to each of the liquid crystal cells along a selected one of the gate lines in a pair of consecutive frames periods of each repeating sequence of a predetermined number of frames periods, and wherein the polarity of the data voltages respectively supplied to each of the liquid crystal cells along the selected one of the gate lines in the remaining frame periods of each repeating sequence of the predetermined number of frames periods alternates for each frame period in the repeating sequence while the scan voltage is supplied to the selected gate line, and for generating the source output enable signal and the gate output enable signal.

The supply of the data voltages having the same polarity to the line in the two frame periods may be executed at intervals of n frame periods when the liquid crystal display panel has a number of lines corresponding to "n".

The data voltages having the same polarity supplied in the two frame periods may be sequentially shifted by one line at intervals of one frame period.

The controller may modulate at least one of the gate output enable signal and the source output enable signal when a line with the same number as a frame number of a second one of the two frame periods, in which the data voltages having the same polarity are supplied, is scanned, to reduce a charge amount of the line.

In another aspect of the present invention, a method for driving a liquid crystal display device including a liquid crystal display panel having a plurality of data lines that cross a plurality of gate lines to define a matrix of liquid crystal cells is provided, the method including: generating a polarity control signal, a source output enable signal, and a gate output enable signal; inverting a polarity of a data voltage in response to the polarity control signal, and supplying the polarity-inverted data voltage to an associated one of the data lines in response to the source output enable signal; supplying a scan voltage sequentially to the gate lines in response to the gate output enable signal; and modulating the polarity control signal such that data voltages having the same polarity are respectively supplied to each of the liquid crystal cells along one gate line in consecutive frame periods.

It is to be understood that both the foregoing general description and the following detailed description of the present invention are exemplary and explanatory and are intended to provide farther explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention.

In the drawings:

FIG. 5 is a view illustrating the polarities of voltages charged in respective frame periods in accordance with an LCD device driving method according to an embodiment of the present invention;

FIG. 7 is a view illustrating the principle of the present invention to prevent the occurrence of DC image sticking in association with scroll data in accordance with the LCD device driving method according to an embodiment of the present invention;

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts.

Hereinafter, embodiments of the present invention will be described with reference to FIGS. 5 to 14.

Figure 1:
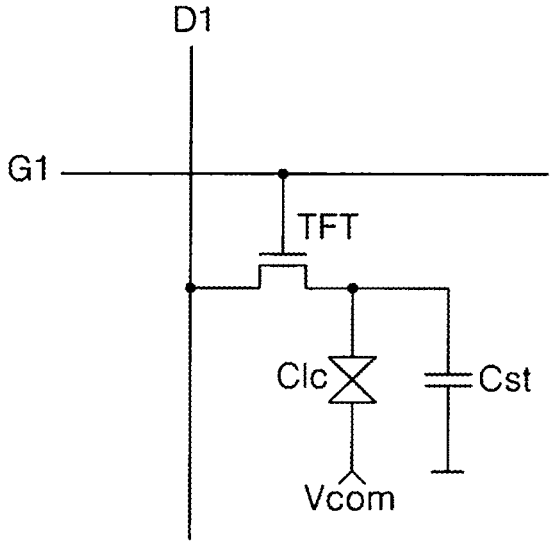
FIG. 1 Related Art
FIG. 1 is an equivalent circuit diagram illustrating one liquid crystal cell of a liquid crystal display (LCD) device.
Figure 2:
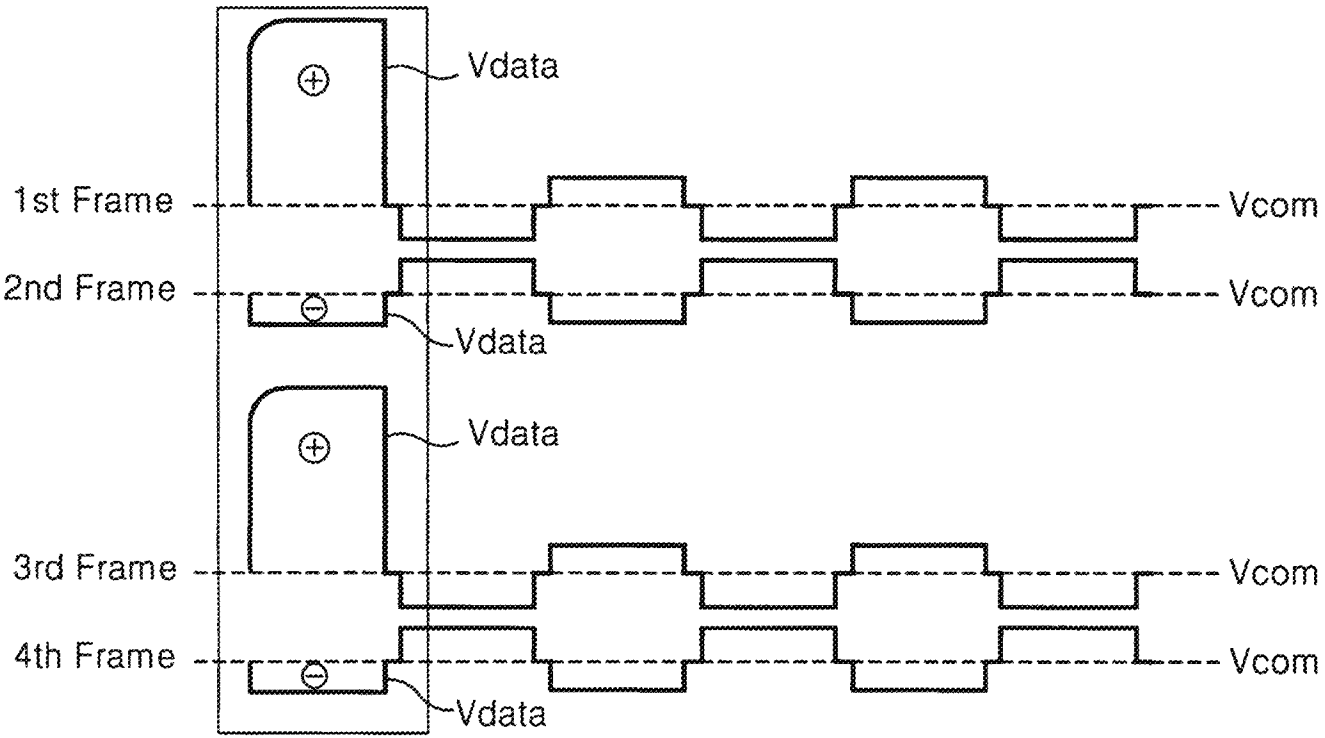
FIG. 2 Related Art
FIG. 2 is a waveform diagram of an example of interlace data.
Figure 3:
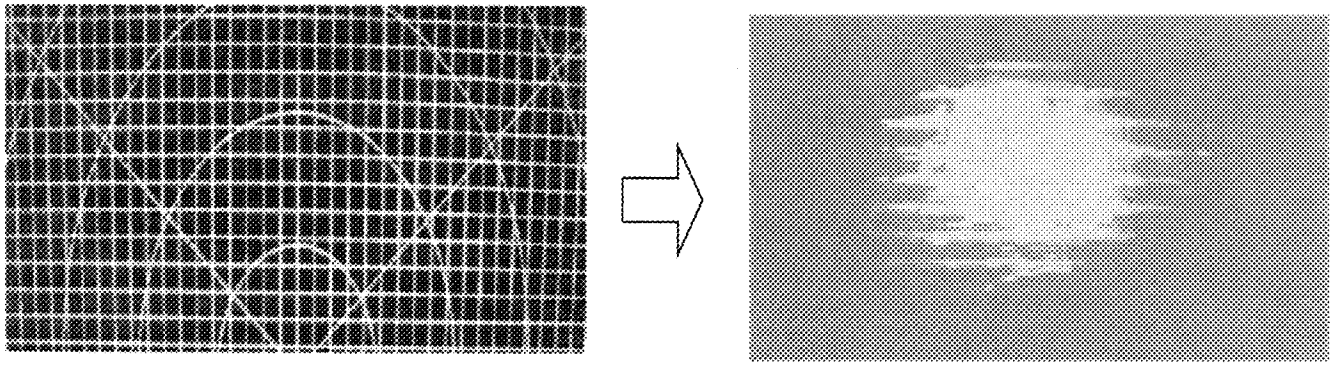
FIG. 3 Related Art
FIG. 3 is a view showing an image displayed on a screen, showing the experimental results of DC image sticking occurring due to interlace data.
Figure 4:
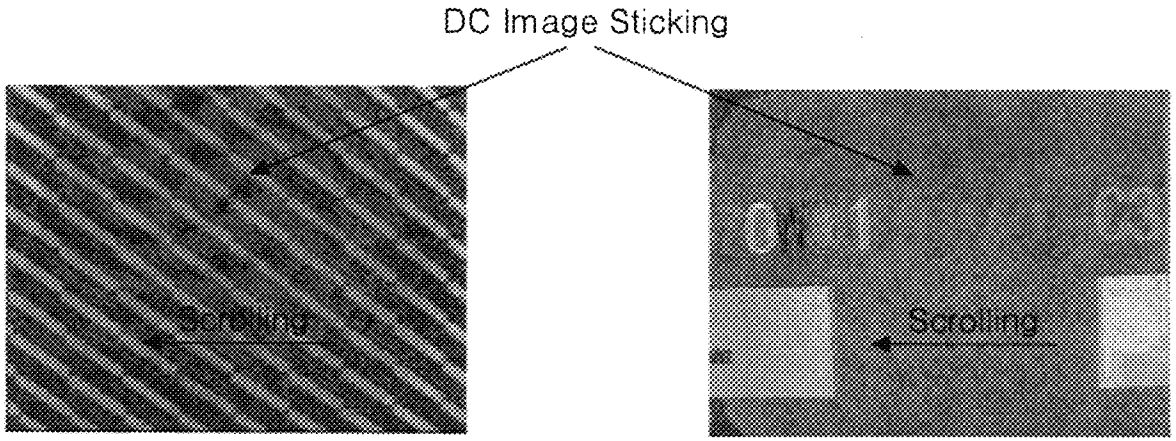
FIG. 4 Related Art
FIG. 4 is a view showing an image displayed on a screen, showing the experimental results of DC image sticking occurring due to scroll data.
Figure 6:
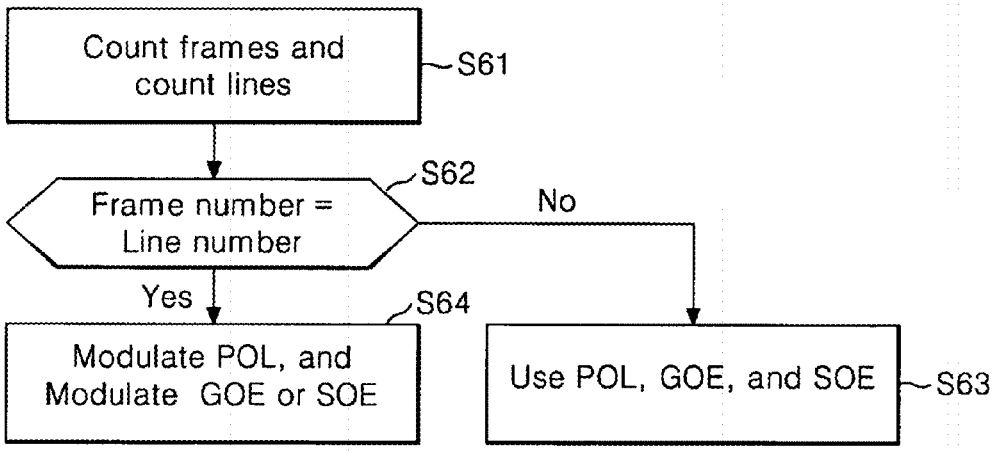
FIG. 6 is a flow chart illustrating a method of driving an LCD device according to an embodiment of the present invention.
Figure 8:
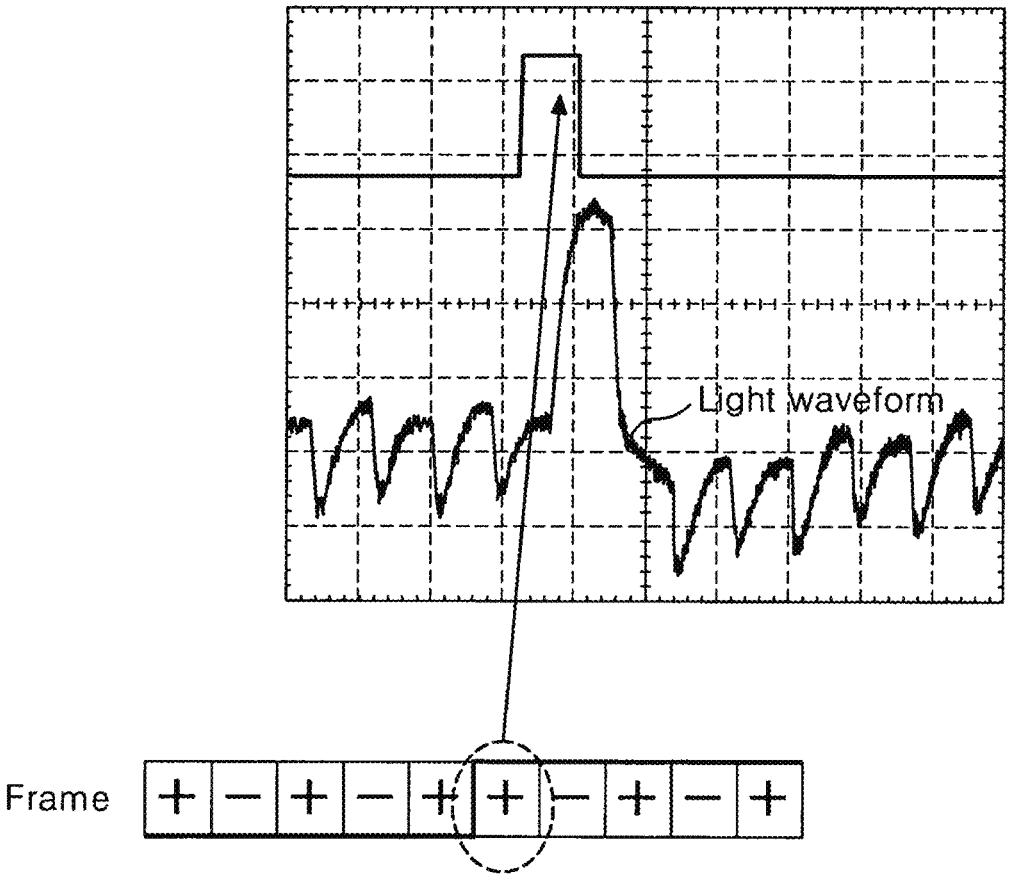
FIG. 8 is a light waveform diagram showing the experimental results showing an abrupt increase in light amount in a second one of two frame periods when data voltages respectively charged in each liquid crystal cell in the two frame periods have the same polarity.

FIG. 5 is a view illustrating the polarities of voltages respectively charged in the same crystal cell in a plurality of frame periods in a liquid crystal display (LCD) device according to an embodiment of the present invention. FIG. 6 is a flow chart illustrating a method for driving the LCD device in accordance with an embodiment of the present invention.

Referring to FIGS. 5 and 6, in the LCD device driving method according to the illustrated embodiment of the present invention, a timing signal that is input together with digital video data is counted to count the number of frames and the number of lines for data will be displayed (S61).

In the LCD device driving method according to the illustrated embodiment of the present invention, when the counted frame number and the counted line number are different from each other, the polarity of a data voltage to be charged in each liquid crystal cell is controlled using a general polarity control signal POL (S62 and S63). The outputting of the data voltage and the outputting of a scan pulse are also controlled using a general gate output enable signal GOE and a general source output enable signal SOE. The polarity control signal POL is a signal for controlling the polarity of the data voltage. Typically, the polarity control signal POL is inverted in logic value at intervals of one horizontal period (or one line) or two horizontal periods in every frame period, to invert the polarity of the data voltage not only at intervals of one line or two lines, but also at intervals of one frame period, as shown in FIG. 5. The source output enable signal SOE is a signal indicating the output time of a data driving circuit. Typically, the source output enable signal SOE controls the data driving circuit such that a data voltage is output for the same output time for every line. The gate output enable signal GOE is a signal indicating the output time of a gate driving circuit. Typically, the gate output enable signal GOE controls the gate driving circuit such that a scan voltage is output for the same output time, for every line. Hereinafter, examples of the data voltage polarity control performed when the counted frame number and the counted line number are different from each other will be described. The polarity of the data voltage to be supplied to one of the liquid crystal cells included in a first line Line #1 in frame periods other than a first frame period, namely, second to Nth frame periods, is inverted at intervals of one frame period. The polarity of the data voltage to be supplied to one of the liquid crystal cells included in a second line Line #2 in frame periods other than the second frame period, namely, the first frame period and the third to Nth frame periods, is inverted at intervals of one frame period. The polarity of the data voltage to be supplied to one of the liquid crystal cells included in a third line Line #3 in frame periods other than the third frame period, namely, the first and second frame periods and the fourth to Nth frame periods, is inverted at intervals of one frame period.

On the other hand, in the LCD device driving method according to the illustrated embodiment of the present invention, when it is determined at step S61 that the counted frame number and the counted line number are equal to each other, the polarity control signal POL associated with the current line is inverted such that the polarity of the data voltage to be displayed on the current line in the current frame is controlled to be identical to the polarity of the data voltage displayed on the same line in the just-previous frame as the current line (S62 and S64). For example, at a scanning time for the first line #1 in the first frame period, the general polarity control signal POL is inverted such that the polarity of the data voltage to be supplied to one of the liquid crystal cells included in the first line #1 in the first frame period is identical to the polarity of the data voltage supplied to the liquid crystal cell in the just-previous frame period. At a scanning time for the second line #2 in the second frame period, the general polarity control signal POL is inverted such that the polarity of the data voltage to be supplied to one of the liquid crystal cells included in the second line #1 in the second frame period is identical to the polarity of the data voltage supplied to the liquid crystal cell in the first frame period. On the other hand, at a scanning time for the third line #3 in the third frame period, the general polarity control signal POL is inverted such that the polarity of the data voltage to be supplied to one of the liquid crystal cells included in the third line #3 in the third frame period is identical to the polarity of the data voltage supplied to the liquid crystal cell in the second frame period. Thus, when it is assumed that the number of lines (horizontal scan lines) in the LCD panel according to the present invention is "n", data voltages having the same polarity are supplied to one line in two successive frames, respectively, at intervals of n frame periods.

However, when the liquid crystal cells included in the same line are charged with data voltages having the same polarity for two successive frame periods, flicker may occur in each line due to the accumulation of data voltages discharged in the liquid crystal cells. For the purpose of reducing or eliminating flicker, in the LCD device driving method according to the illustrated embodiment of the present invention, the pulse width of the source output enable signal SOE or gate output enable signal GOE may be increased at a second one of frame scanning times for a line, to which data voltages having the same polarity are supplied in two successive frame periods, respectively, to reduce the data charge amount of liquid crystal cells in the line in a second one of the two successive frame periods.

FIGS. 7 to 10 are views illustrating the effects of preventing DC image sticking and flicker from occurring when scroll data is supplied to the LCD device, in accordance with embodiments of the present invention.

In accordance with embodiments of the present invention, for scroll data to move a symbol or character at a certain rate, polarity control signals POL having the same polarity pattern are generated in two successive periods, respectively, at intervals of n frames, to control the polarities of the data voltages respectively supplied to the same liquid crystal cell in the two successive frame periods such that the polarities of the data voltages are varied in the order of "++"→"−−"→"++"→"−−". Thus, in accordance with the present invention, for scroll data to move a symbol or character at a certain rate, the polarity of the voltage, which is charged in each liquid crystal cell, is controlled to be periodically inverted, thereby preventing DC image sticking occurring due to an accumulation of voltages having the same polarity.

Figure 9:
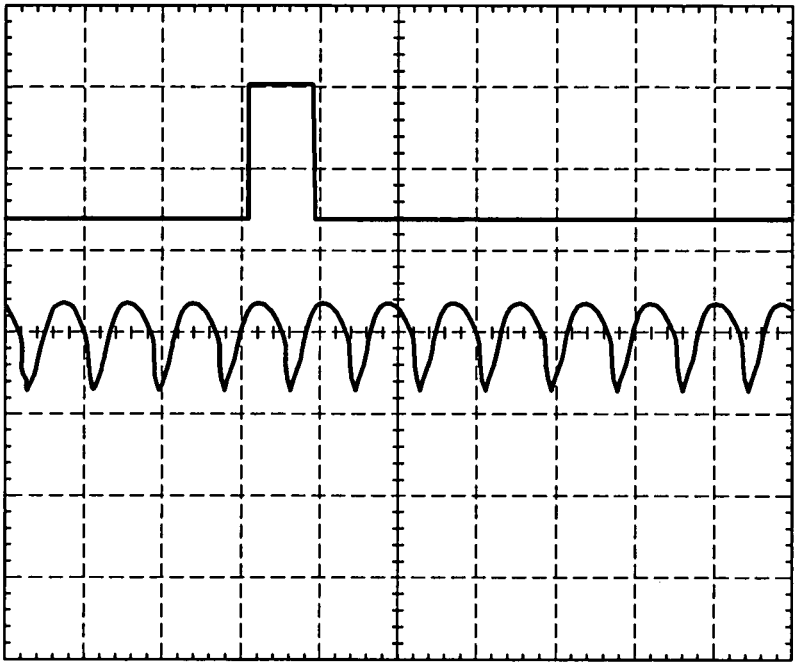
FIG. 9 is a light waveform diagram depicting light waveforms experimentally obtained in a plurality of frame periods in the LCD device according to an embodiment of the present invention.

When a data voltage having the same polarity as the data voltage supplied in the just-previous frame period is supplied to liquid crystal cells in the current frame period, an increase in brightness over a desired brightness may occur due to an overcharge of data voltages. The overcharge may produce a flicker. However, in accordance with the LCD device driving method according to the illustrated embodiment of the present invention, it is possible to prevent the occurrence of flicker in each frame or each line by supplying, to the liquid crystal cells in one line in the current frame period, a data voltage having the same polarity as the data voltage in the just-previous frame period, while increasing the pulse width of the source output enable signal or gate output enable signal at the scanning time for the line, thereby reducing the charged amounts of the liquid crystal cells, as shown in FIG. 9.

Figure 10:
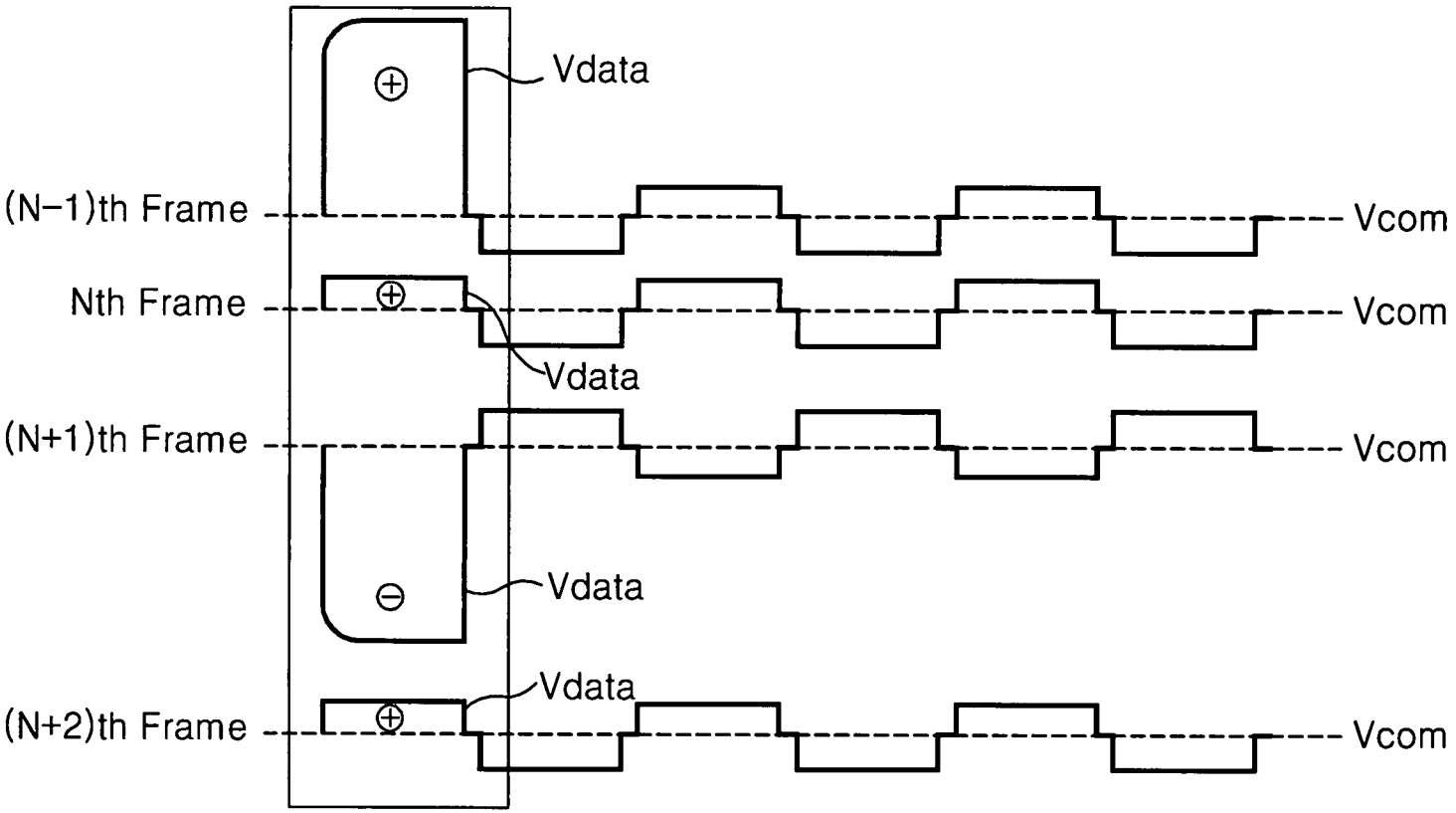
FIG. 10 is a view illustrating the principle of preventing DC image sticking and flicker from occurring in association with interlace data in the LCD device driving method according to an embodiment of the present invention.

FIG. 10 illustrates the principle of preventing DC image sticking and flicker from occurring when interlace data is supplied to the LCD device in accordance with the above-described embodiments of the present invention.

Referring to FIG. 10, when interlace data is supplied to the liquid crystal cell Clc, high data voltages are supplied to the liquid crystal cell Clc only in the (N−1)th frame period and (N+1)th frame period, respectively, whereas a black voltage or a mean (intermediate) voltage lower than the high data voltages, is supplied to the liquid crystal cell Clc in the Nth frame period and (N+2)th frame period. As a result, the positive data voltage supplied in the (N+1)th frame period and the negative data voltage supplied in the (N+1)th frame period are neutralized, so that there is no polarity-biased voltage accumulated in the liquid crystal cell Clc. Accordingly, no DC image sticking or flicker occurs in the LCD device when interlace data is supplied, in accordance with the embodiment of the present invention.

Figure 11:
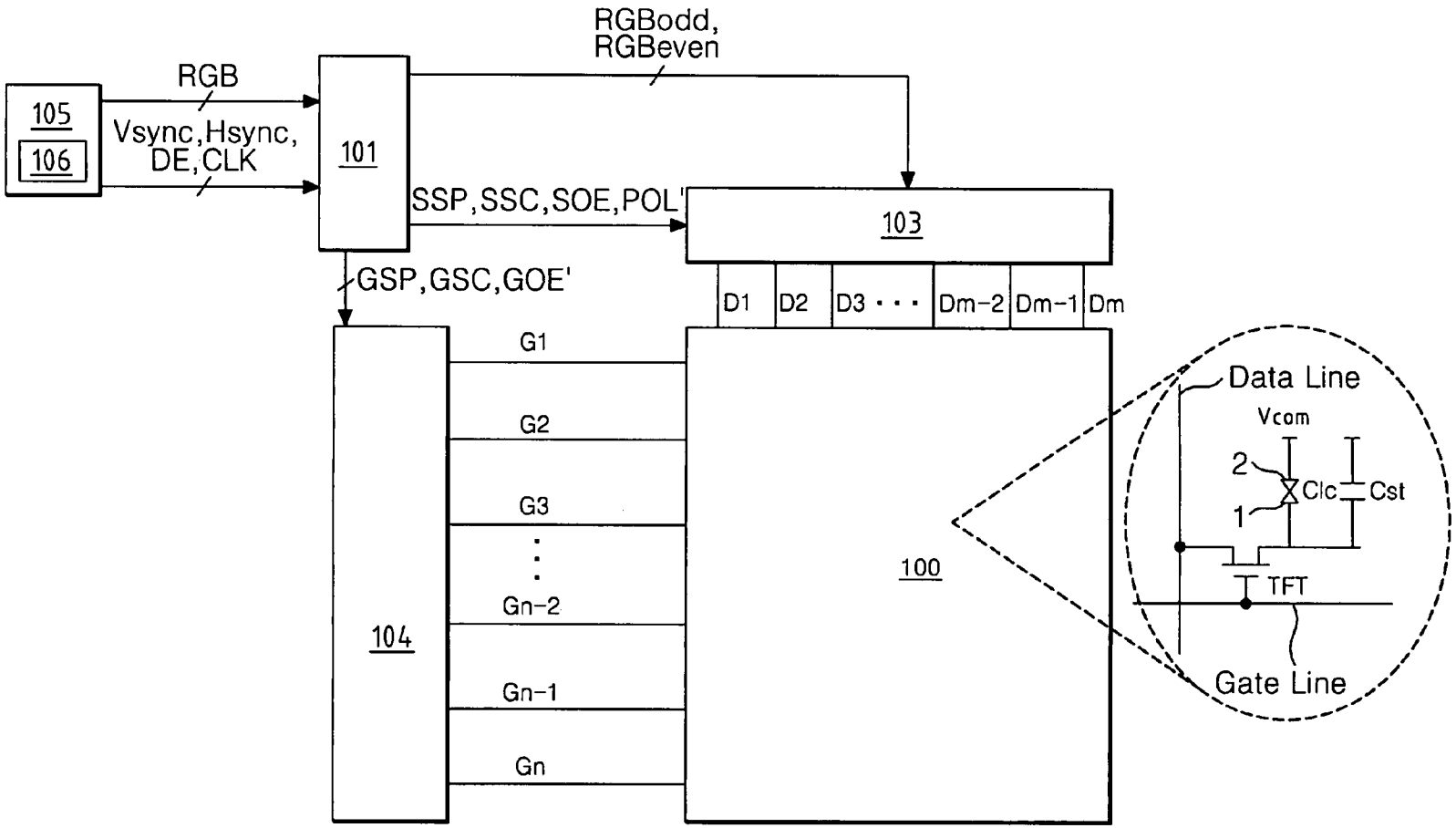
FIG. 11 is a block diagram illustrating an LCD device according to an embodiment of the present invention.
Figure 12:
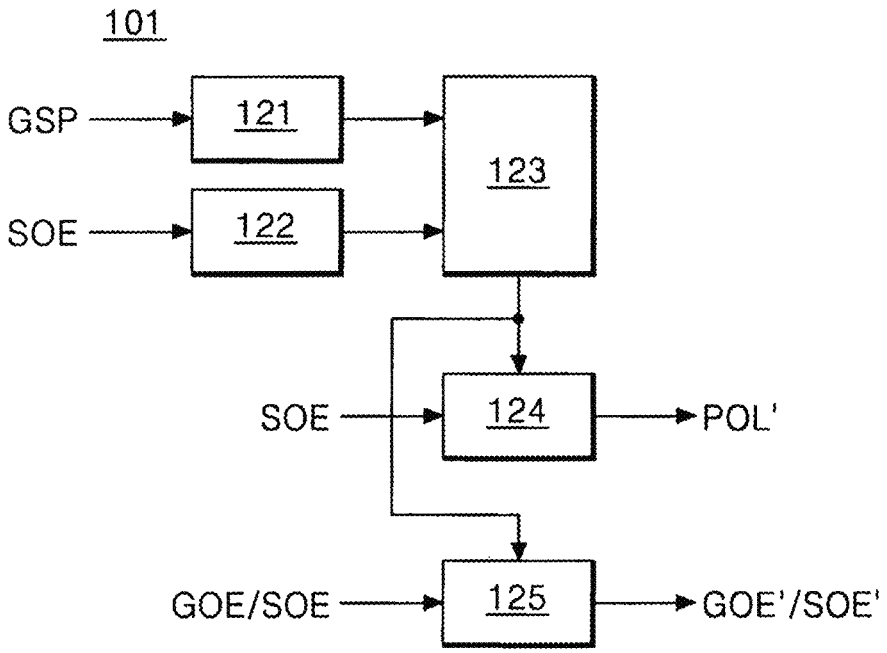
FIG. 12 is a block diagram illustrating a detailed configuration of a timing controller of the LCD device shown in FIG. 11.

FIG. 11 is an LCD device according to an embodiment of the present invention. FIG. 12 is a block diagram concretely illustrating a part of a timing controller of the LCD device shown in FIG. 11.

Referring to FIGS. 11 and 12, the LCD device according to the illustrated embodiment of the present invention includes an LCD panel 100, a timing controller 101, a data driving circuit 103, and a gate driving circuit 104.

The LCD panel 100 includes two glass substrates, between which liquid crystal molecules are sealed. The LCD panel 100 also includes m×n liquid crystal cells Clc arranged in a matrix defined by the crossing of m data lines D1 to Dm with n gate lines G1 to Gn.

Formed on a lower one of the glass substrates of the LCD panel 100 are the data lines D1 to Dm, the gate lines G1 to Gn, thin film transistors (TFTs), pixel electrodes 1 of respective liquid crystal cells Clc coupled to the TFTs, and storage capacitors Cost. A black matrix, color filters, and common electrodes 2 are formed on the upper glass substrate. In a vertical electric field driving system such as a twisted nematic (TN) mode or a vertical alignment (VA) mode, the common electrodes 2 are formed on the upper glass substrate, as described above. On the other hand, in a horizontal electric field driving system such as an in-plane switching (IPS) mode or a fringe field switching (FFS) mode, the common electrodes 2 are formed on the lower glass substrate together with the pixel electrodes 1. Polarizing plates having optical axes orthogonal to each other are attached to the upper and lower glass substrates, respectively. An alignment film is formed at an interface between each polarizing plate and the liquid crystals, to set a pre-tilt angle of the liquid crystals.

The timing controller 101 receives timing signals Vsync, Hsync, DE, and CLK, and generates timing control signals to control the operation timings of the data driving circuit 103 and gate driving circuit 104, based on the received timing signals. The timing control signals include gate timing control signals such as a gate start pulse GSP, a gate shift clock signal GSC, and a gate output enable signal GOE. The timing control signals also include data timing control signals such as a source start pulse SSP, a source sampling clock SSC, a source output enable signal SOE, and a polarity control signal POL. The gate start pulse GSP is a timing control signal indicating a first scan pulse to be supplied to a start horizontal line, from which a scanning operation starts in one vertical period for displaying one frame, namely, a first gate line. The gate shift clock signal GSC is a timing control signal, which is input to shift registers included in the gate driving circuit 104, to sequentially shift the gate start pulse GSP. The source start pulse SSP indicates a start pixel on one horizontal line to display data. The source sampling clock SSC enables a data latch operation of the data driving circuit 103 based on a rising or falling edge. The source output enable signal SOE enables an output from the data driving circuit 103. The polarity control signal POL indicates the polarity of a data voltage to be supplied to the liquid crystal cells Clc of the LCD panel 100. The timing controller 101 also divides input digital video data RGB into odd pixel data RGBodd and even pixel data RGBeven, thereby reducing the transfer frequency for the data to be supplied to the data driving circuit 103 to ½.

As shown in FIG. 5, the timing controller 101 generates the polarity control signal POL. In accordance with the polarity control signal POL, in every frame period, a data voltage having the same polarity as the data voltage supplied in the just-previous frame period is supplied to each liquid crystal cell of one line. The timing controller 101 also increases the pulse width of the gate output enable signal GOE or source output enable signal SOE in the second one of the two successive frame periods, in order to reduce the charged amount of the data voltage in each liquid crystal cell of the line. For these functions, the timing controller 101 includes a frame counter 121, a line counter 122, a comparator 123, a first logic circuit 124, and a second logic circuit 125.

The gate start pulse GSP is generated at nearly the same time as the start of one frame period and is generated once in one frame period. The frame counter 121 counts the gate start pulse GSP to count the number of frames. When the number of lines in the LCD panel is "n", the frame counter 121 resets the frame count value at intervals of "n".

The source output enable signal SOE is generated at intervals of about one horizontal period. The line counter 122 counts the source output enable signal SOE, to count the number of lines, on which data will be displayed. When the number of lines in the LCD panel is "n", the line counter 122 resets the line count value at intervals of "n".

The comparator 123 compares the frame count value output from the frame counter 121 and the line count value output from the line counter 122, and generates an output signal having a predetermined logic value when the frame count value and line count value are equal to each other.

In response to the output from the comparator 123, the first logic circuit 124 inverts the polarity control signal POL when the line with the same number as the counted frame number is scanned, and outputs the inverted signal as a polarity control signal POL'. In accordance with the polarity control signal POL' output from the first logic circuit 124, the data driving circuit 103 performs a control operation such that the polarity of the data voltage to be supplied to the line with the same number as the counted frame number is identical to the polarity of the data voltage supplied in the just-previous frame period.

Figure 13:
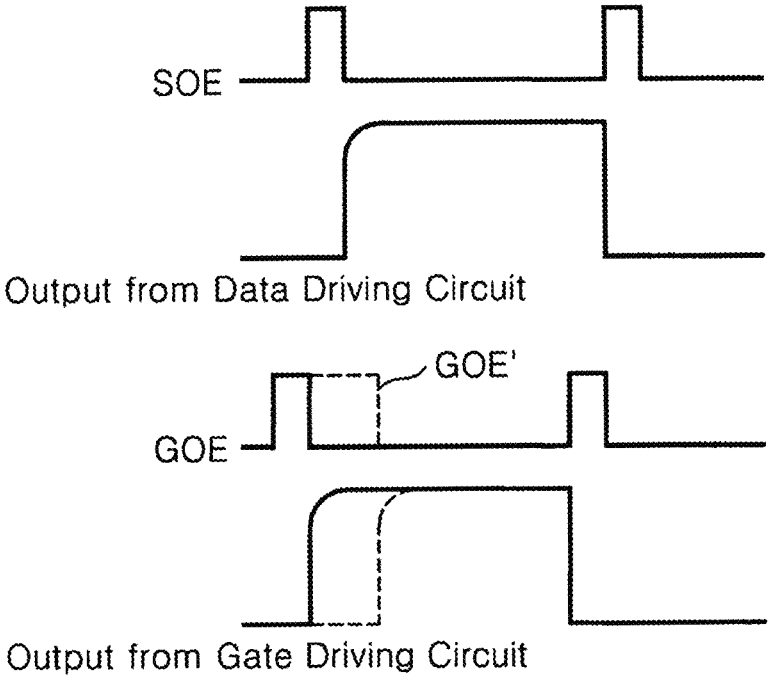
FIG. 13 is a waveform diagram depicting a gate output enable signal modulated when a line with the same number as the frame number of a second one of two frame periods, in which data voltages having the same polarity are supplied, is scanned.
Figure 14:
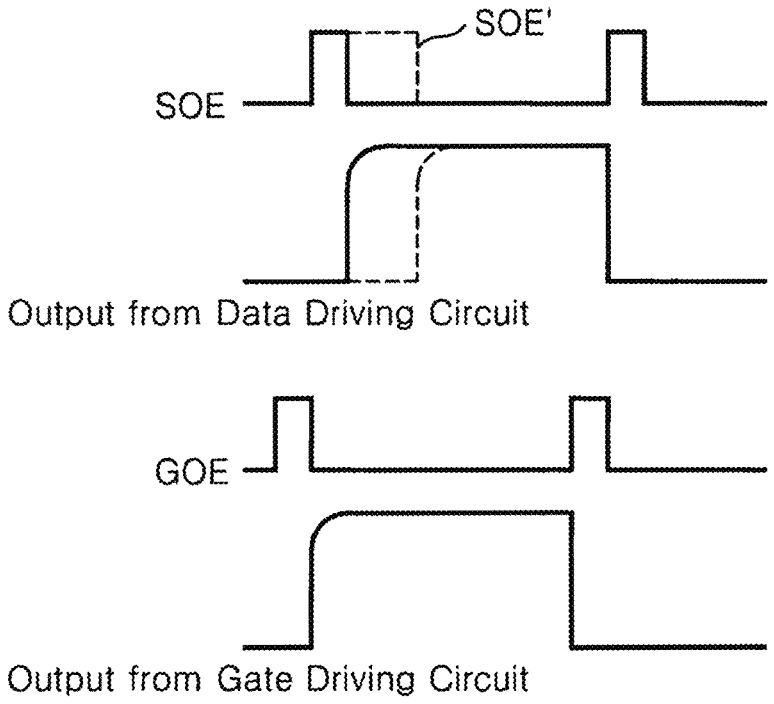
FIG. 14 is a waveform diagram depicting a source output enable signal modulated when a line with the same number as the frame number of a second one of two frame periods, in which data voltages having the same polarity are supplied, is scanned.

In response to the output from the comparator 123, the second logic circuit 125 increases the pulse width of the gate output enable signal GOE or source output enable signal SOE when the line with the same number as the counted frame number is scanned to reduce the data voltage amount charged to the liquid crystal cells in the line. A scan voltage is generated from the gate driving circuit 104 in a low-logic period between successive pulses of the gate output enable signal GOE, as shown in FIG. 13. The gate output enable signal GOE, which is modulated by the second logic circuit 125, namely, a modulated gate output enable signal GOE', has an increased pulse width (broken line) when the line with the same number as the frame number of a second one of two successive frame periods, in which data voltages having the same polarity are supplied, respectively, is scanned. As a result, the charge amount of the data voltage supplied to each liquid crystal cell on the above-described line is reduced. As shown in FIG. 14, a data voltage is output from the data driving circuit 103 in a period between successive pulses of the source output enable signal SOE. The source output enable signal SOE, which is modulated by the second logic circuit 125, namely, a modulated source output enable signal SOE', has an increased pulse width (broken line) when the line with the same number as the frame number of a second one of two successive frame periods, in which data voltages having the same polarity are supplied, respectively, is scanned. As a result, the charge amount of the data voltage supplied to each liquid crystal cell on the above-described line is reduced. The second logic circuit 125 may alternatively modulate both the source output enable signal SOE and the gate output enable signal GOE, to reduce the charge amount of the data voltage supplied to each liquid crystal cell on the line with the same number as the frame number of the second one of the two successive frame periods, in which data voltages having the same polarity are supplied, respectively, when the line is scanned.

The data driving circuit 103 latches digital video data RGBodd and digital video data RGBeven under the control of the timing controller 101. The data driving circuit 103 also converts the latched digital video data RGBodd and RGBeven into positive/negative analog gamma compensating voltages in accordance with the polarity control signal POL', and thus generates positive/negative analog data voltages. The data voltages from the data driving circuit 103 are supplied to the data lines D1 to Dm.

The gate driving circuit 104 includes a plurality of gate drive integrated circuits each including a shift register, a level shifter for converting an output signal of the shift register into a signal having a swing width suitable for the driving of the TFTs of the associated liquid crystal cells, and an output buffer coupled between the level shifter and an associated one of the gate lines G1 to Gn. The gate driving circuit 104 sequentially supplies a scan pulse to the gate lines G1 to Gn, in response to the gate timing control signals.

The LCD device according to the illustrated embodiment of the present invention further includes a system 105 for supplying the digital video data RGB and timing signals Vsync, Hsync, DE, and CLK to the timing controller 101.

The system 105 may includes a broadcast signal receiver, an external appliance interface circuit, a graphic processing circuit, a line memory 106, and other components depending on the application and use of the system 105. The system 105 extracts video data from a broadcast signal received by the broadcast signal receiver or an image source input from an external appliance through the external appliance interface circuit, converts the extracted video data into digital video data, and supplies the digital video data to the timing controller 101. An interlaced broadcast signal received by the system 105 is stored in the line memory 106. The video data of the interlaced broadcast signal supplies only on odd lines in odd frame periods, and supplies only on even lines in even frame periods. Accordingly, when the system 105 receives an interlaced broadcast signal, the system 105 generates even line data for odd frame periods and odd line data for even frame periods, using a mean value of effective data stored in the line memory 106 or a black data value. The system 105 supplies the timing signals Vsync, Hsync, DE, and CLK to the timing controller 101 together with the digital video data. The system 105 also supplies electric power to a DC-DC converter functioning to generate drive voltages for the timing controller 101, data driving circuit 103, gate driving circuit 104, and LCD display panel 100. The system 105 also supplies electric power to an inverter for energizing a light source included in a backlight unit for the LCD device.

As is apparent from the above description, in accordance with the LCD device and driving method thereof according to any one of the above-described embodiments of the present invention, the occurrence of DC image sticking and flicker may be reduced or eliminated by modulating a polarity control signal such that the polarity of a data voltage to be supplied to one line in every frame period is identical to the polarity of the data voltage supplied to the same line in the just-previous frame period. In accordance with the LCD device and driving method thereof according to any one of the above-described embodiments of the present invention, it is possible to further reduce the occurrence of flicker by modulating the gate output enable signal and/or source output enable signal, to reduce the charge amount of the data voltage supplied to the line with the same number as the frame number of a second one of two successive frame periods, in which data voltages having the same polarity are supplied, respectively, when the line is scanned.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device comprising:

a liquid crystal display panel having a plurality of data lines that cross a plurality of gate lines, defining a matrix of a plurality of liquid crystal cells;

a controller that outputs a polarity control signal, a source output enable signal, and a gate output enable signal;

a data driving circuit that supplies data voltages to the plurality of data lines in response to the source output enable signal; and a gate driving circuit that sequentially supplies a scan voltage to each of the plurality of gate lines in response to the gate output enable signal;

wherein the polarity control signal is generated by the controller in accordance with an interlace driving scheme in which the data voltages are supplied to liquid crystal cells of the plurality of liquid crystal cells that are connected to odd-numbered gate lines of the plurality of gate lines during odd-numbered frame periods, while being supplied to liquid crystal cells of the plurality of liquid crystal cells that are connected to even-numbered gate lines of the plurality of gate lines during even-numbered frame periods, except when the controller determines that a counted frame number is equal to a counted number of one of the plurality of gate lines that is supplied with the scan voltage, wherein when the controller determines that the counted frame number is equal to the counted number of one of the plurality of gate lines that is supplied with the scan voltage, a logic value of the polarity control signal is inverted, and wherein when the controller determines that the counted frame number is equal to the counted number of one of the plurality of gate lines that is supplied with the scan voltage, the controller increases a pulse width of both the gate output enable signal and the source output enable signal.

2. The liquid crystal display device according to claim 1, wherein the selected one of the gate lines is sequentially shifted by one gate line at intervals of one frame period.

3. The liquid crystal display device according to claim 1, wherein the controller increases a pulse width of at least one of the gate output enable signal and the source output enable signal when a gate line of the plurality of gate lines having the same number as a frame number of a second one of the pair of consecutive frame periods is scanned to reduce a charge amount of data voltage supplied to liquid crystal cells along the gate line having the same number as a frame number of a second one of the pair of consecutive frame periods.

* * * * *